US008943994B2

(12) United States Patent
Baldwin

(10) Patent No.: US 8,943,994 B2
(45) Date of Patent: Feb. 3, 2015

(54) CATAMARAN-STYLE WATERCRAFT WITH A MANUALLY ADJUSTABLE BEAM

(76) Inventor: Aaron Leland Baldwin, McClellanville, SC (US)

( * ) Notice: Subject to any disclaimer, the term of this patent is extended or adjusted under 35 U.S.C. 154(b) by 255 days.

(21) Appl. No.: 13/585,793

(22) Filed: Aug. 14, 2012

(65) Prior Publication Data

US 2013/0042799 A1 Feb. 21, 2013

Related U.S. Application Data

(60) Provisional application No. 61/575,110, filed on Aug. 16, 2011.

(51) Int. Cl.
*B63B 1/22* (2006.01)
*B63B 1/14* (2006.01)

(52) U.S. Cl.
CPC ..... *B63B 1/14* (2013.01)
USPC ..... 114/284

(58) Field of Classification Search
CPC ..... B63B 1/10; B63B 1/107; B63B 1/12; B63B 1/121; B63B 1/14
USPC ..... 114/61.1, 61.12, 61.14, 61.15, 61.18, 114/61.22, 39.26, 39.27, 39.28
See application file for complete search history.

(56) References Cited

U.S. PATENT DOCUMENTS 2,944,505 A * 7/1960 Berge ..... 114/39.27
5,474,009 A * 12/1995 Ritchie et al. ..... 114/61.18

* cited by examiner

*Primary Examiner* — Daniel V Venne
(74) *Attorney, Agent, or Firm* — B. Craig Killough; Barnwell Whaley Patterson & Helms

(57) ABSTRACT

A catamaran-style watercraft with a manually adjustable beam. The beam expanded or contracted by an operator applying force in a desired direction to a given hull. Movement is afforded by adjustable-length crossbars, which span and connect each of the two hulls, allowing the hulls to slide beneath the underside of an operator-supporting platform deck.

18 Claims, 8 Drawing Sheets

CATAMARAN-STYLE WATERCRAFT WITH A MANUALLY ADJUSTABLE BEAM

CROSS-REFERENCE TO RELATED APPLICATIONS

This application claims priority to provisional application No. 61/575,110 filed on Aug. 16, 2011.

STATEMENT REGARDING FEDERALLY SPONSORED RESEARCH AND DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention relates to watercraft and specifically to a catamaran-style, recreational watercraft with an adjustable beam.

Canoeing, kayaking, rowing and sailing have long been popular water sports. As healthy, environmentally clean avenues for recreation, their appeal should continue to grow.

Each of the aforementioned water sports employs its own specialized boat-form, so that with new boating interests or changes in boating conditions an individual might need to acquire new craft, increasing financial burden and creating issues related to storage.

Since one of the main factors impacting watercraft performance is the ratio of width or beam to length, a boat constructed to have a variable beam could potentially serve multiple functions and be made to suit a variety of boating conditions. The most straightforward means for creating an adjustable beam is to modify a traditional catamaran-form, so as to allow for the spacing between pontoons or hulls to be deliberately altered by an operator.

There have been many proposed and realized examples of multihulled vessels with adjustable beams. In the majority of cases the inventor's goal has been to enjoy the stability of wide, multihulled craft, while meeting width restrictions related to trailering the boats on roads and highways.

The adjustable beam craft described in U.S. Pat. No. 2,992,444, U.S. Pat. No. 4,909,169, U.S. Pat. No. 6,003,458, U.S. Pat. No. 6,874,440, U.S. Pat. No. 7,628,115, B2, U.S. Pat. No. 6,546,885 B1, U.S. Pat. No. 3,981,259, U.S. Pat. No. 5,651,706, and U.S. Pat. No. 4,172,426 were drawn toward allowing trailering and reducing storage space requirements. In each of these cases, the watercraft's narrowest configuration was not considered as an operative condition. Further, the apparatuses employed are relatively complex and likely demand mechanical aid in generating the required force to reposition hulls.

Since the desire to reduce boat width has mostly related to transport, little consideration has been given to a narrow or retracted configuration as a functional state.

The design recorded under U.S. Patent 2007/0028830 A1 is one exception. Here the last section of the stern of the craft is bisected forming two small self-contained hull sections separate from the main hull. The small sections are hinged to the larger section in such a way as to allow them to pivot outward, effectively expanding the beam, hence, adding to the stability of the craft. The design is meant to allow for effective paddling from a seated position when the smaller hulls are retracted and fishing from a standing position when expanded.

One drawback of this design is that the relatively small size of the pivoting hulls limits the stability offered. Also problematic, is the complexity of the pivoting mechanism, which is comprised of an arrangement of cables, pulleys, hinges and levers.

Another invention that seeks to exploit the versatility of a watercraft by varying the beam is described in U.S. patent 2003/0213423 A1. In this design, two hull segments may be joined together into one or configured as a two-hulled catamaran using a collapsible frame to separate the hull sections. This craft provides multiple uses and propulsion options, but requires that the operator assemble and disassemble components in order to achieve the desired adjustments.

BRIEF SUMMARY OF THE INVENTION

The object of the present invention is to provide a recreational watercraft, with functional versatility, afforded by a manually adjustable beam.

In a particular embodiment the present invention includes two, decked hulls, connected by two, adjustable-length crossbars and spanned by a rigid platform deck. The construction and arrangement of the aforementioned elements allows the craft's operator to manually adjust, within set limits, the lateral position of each hull relative to the longitudinal centerline of the platform deck.

The operation of laterally positioning the hulls is made possible by adjustable-length crossbars. An obvious method for constructing adjustable crossbars might be to employ a telescoping arrangement whereby a crossbar segment, connected to one pontoon, slides inside of a larger diameter crossbar segment, attached to the opposite pontoon. In the present invention, however, the limited reach of the telescoping members relative to the performance requirements and necessary structural integrity would not be great enough. Also, the frictional force associated with telescoping members, as described above, would be difficult to overcome.

In the present invention, adjustable crossbars are each configured from pairs of rigid members or bar segments fed through specialized pieces of hardware, henceforth referred to in this document as "slide blocks." The slide blocks are mounted securely to the underside of the platform deck, centered on the longitudinal centerline with one positioned near the bow end and the other near the stern. The slide blocks are fabricated so that each possesses two parallel passages, one for each of the bar segments. The passages are dimensioned so as to allow the bar segments to pass freely but not sloppily through them. Enough space is provided between the passages to allow the bar segments to avoid contact with one another when sliding past. Each bar segment runs through its own passage in the slide block, perpendicular to the hulls and is connected in a fixed manner to one of the hulls at a determined placement.

With the bar segments fed into the slide block passages and the components securely connected, as described above, the relative position of hulls and deck are locked in all directions other than along a transverse line. The pontoons are able to be moved in and out.

Handles, located near the transverse center line on the top, outer edge of each hull, provide points upon which the operator may apply force toward retracting and expanding the lateral positions of the hulls.

The merits of the present invention lie in its versatility and simplicity of construction. Scaled to accommodate one or two operators, the craft could, in its narrowest configuration, be paddled from a position seated on the platform deck, using a kayak paddle or single-blade paddle. The narrow configuration would also allow the craft to be transported in the bed of most pick-up trucks or secured to a car top. In its widest configuration, the platform deck could be stood upon for fishing or stand-up paddling. Also, in its widest configuration the present invention could accommodate a sail rig, small motor, or pedal-drive.

The apparatus for laterally adjusting pontoons requires a minimum of moving parts and no machine is necessary for generating the force necessary for positioning the hulls. No assembly or disassembly is required in order to adjust hull spacing, although the present invention can be quickly and easily disassembled into three main parts and then, as quickly and easily, reassembled if desired by the operator.

The foregoing provides a broad description of the present invention and its advantages. The accompanying drawings with their descriptions below, along with the detailed description to follow will further explain the assembly of components, operation and novel features of the present invention. The drawings referred to in the following descriptions are intended to be illustrative and not restrictive toward describing the present invention.

DETAILED DESCRIPTION OF THE INVENTION

Figure 1:
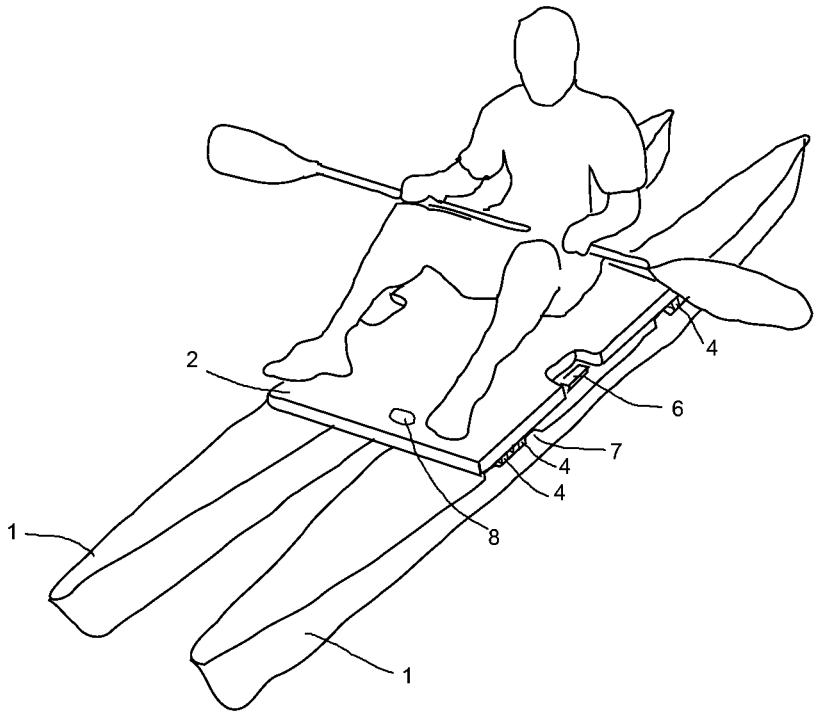
FIG. 1 is a perspective of the present invention in its closed or retracted configuration with an operator shown paddling.
Figure 2:
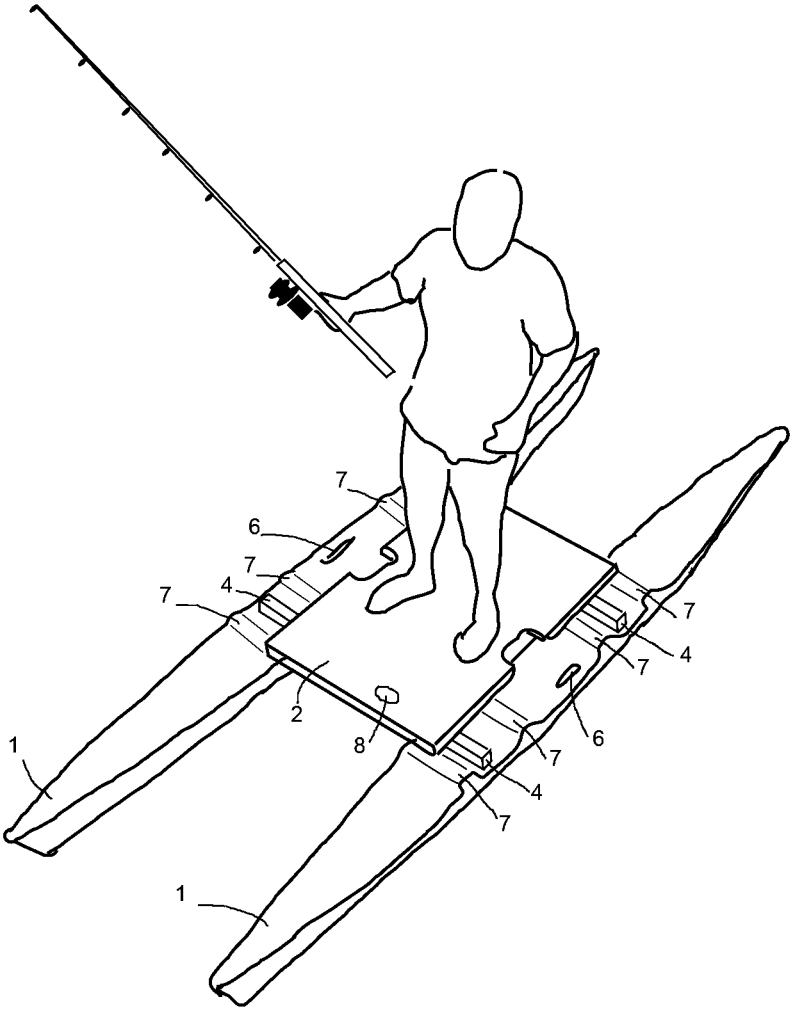
FIG. 2 is a perspective of the present invention in its open or extended configuration with an operator fishing.
Figure 3:
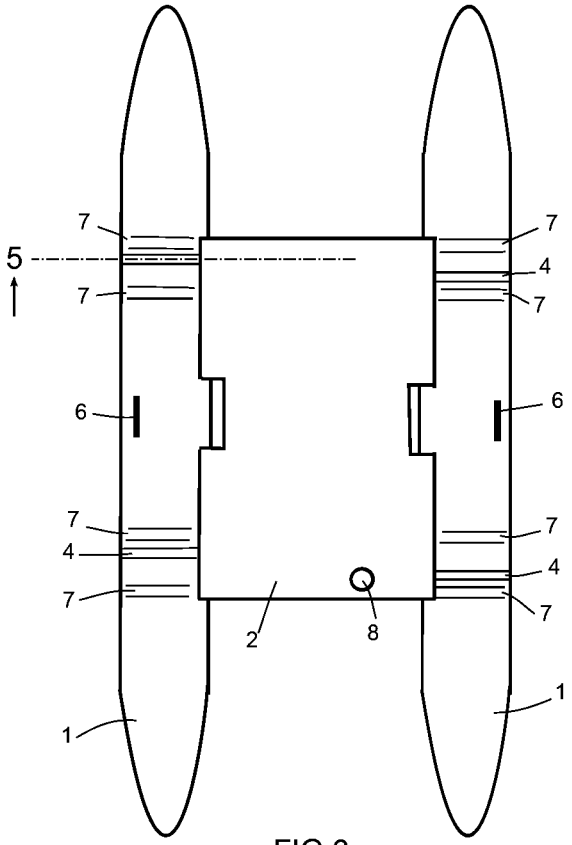
FIG. 3 is a plan of the topside of the present invention in its open configuration.
Figure 4:
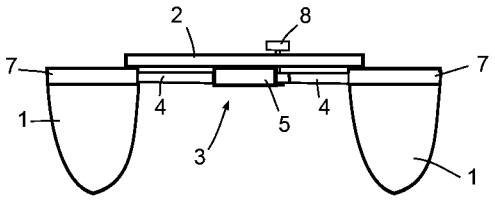
FIG. 4 is an end elevation of the present invention in its open configuration.
Figure 5:
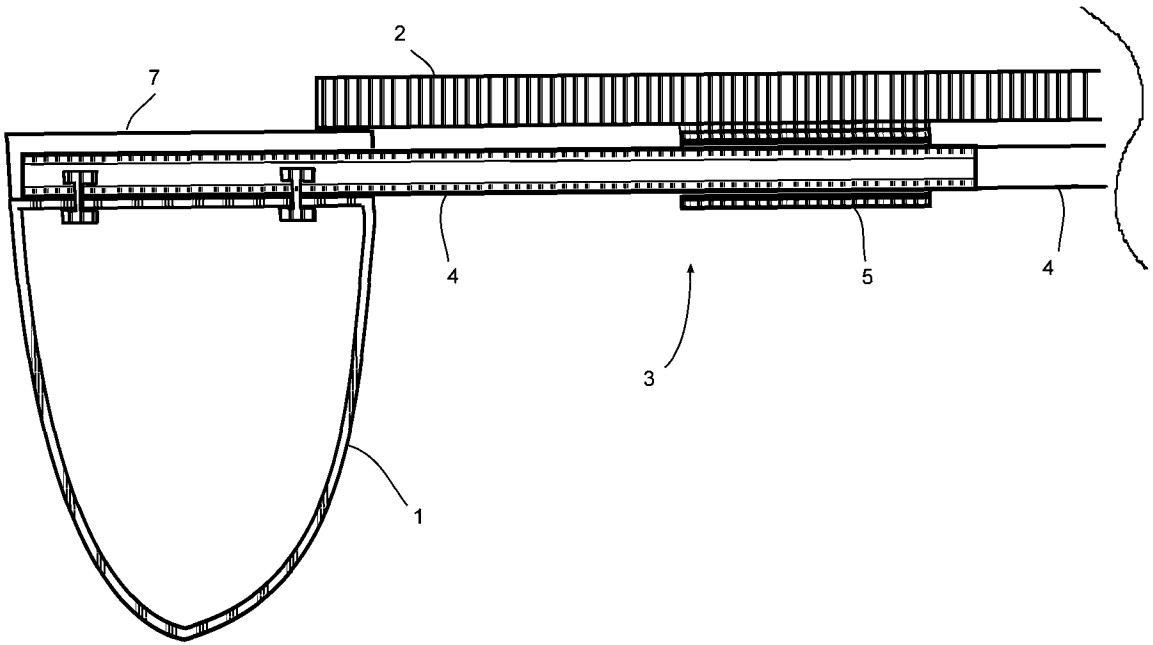
FIG. 5 is section detail showing cut laterally at along a line indicated in FIG. 3.
Figure 6:
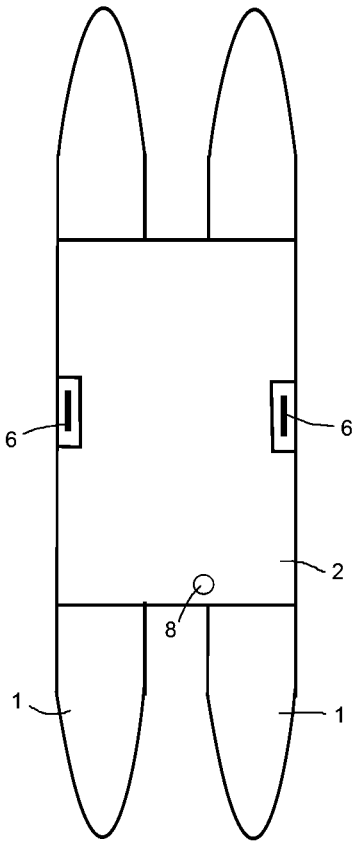
FIG. 6 is a plan of the topside of the present invention in its closed configuration.
Figure 7:
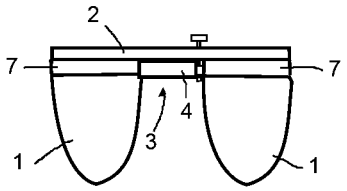
FIG. 7 is an end elevation of the present invention in its closed configuration.
Figure 8:
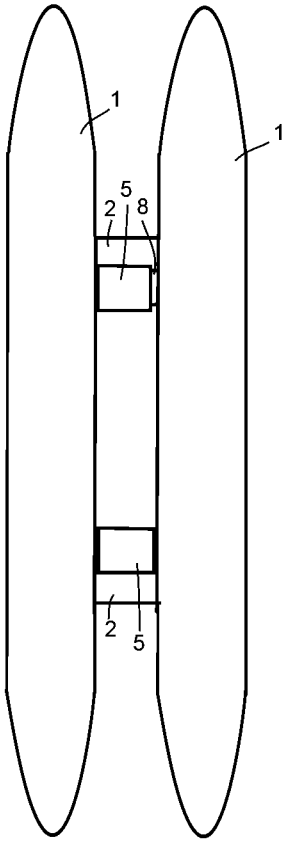
FIG. 8 is a plan of the underside of the present invention in its closed configuration.
Figure 9:
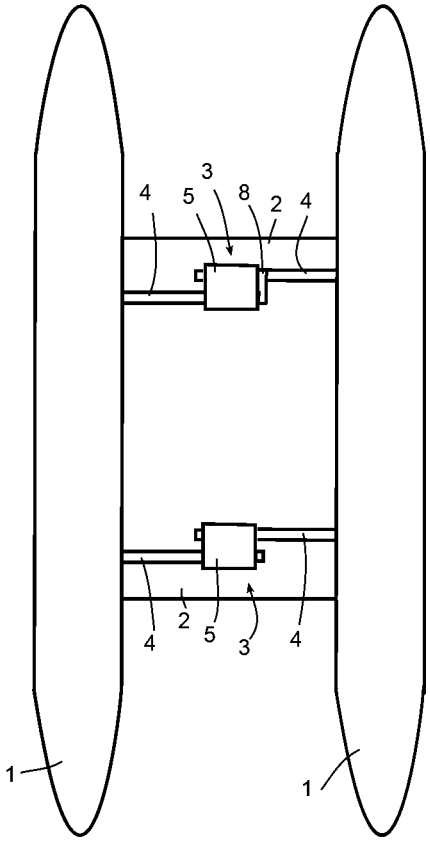
FIG. 9 is a plan of the underside of the present invention in its open configuration.
Figure 10:
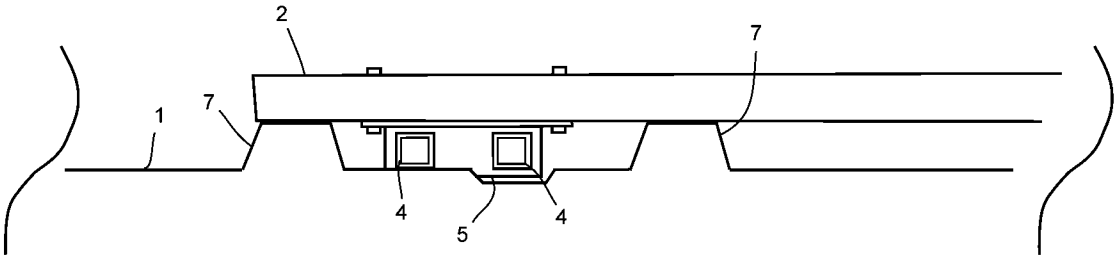
FIG. 10 is a detail of a side elevation of the present invention, focusing on the intersection of the platform deck and hull at the area where the adjustable-length crossbar meets the hull.
Figure 11:
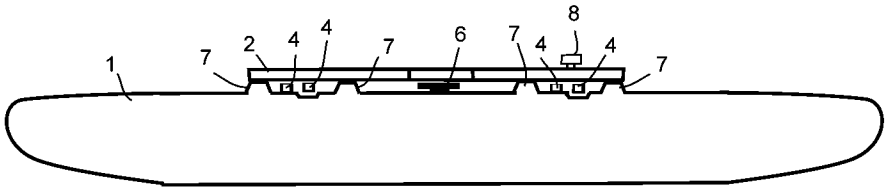
FIG. 11 is a side elevation of the present invention.
Figure 12:
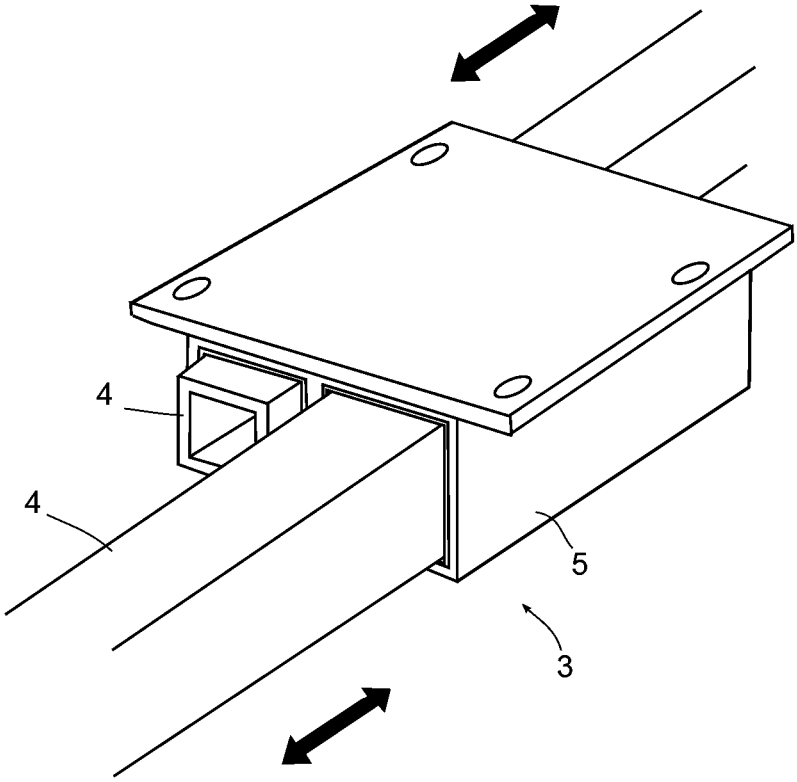
FIG. 12 is a detail of a perspective showing the area of the adjustable-length crossbar where the bar segments pass through the slide block.

As discussed above, embodiments of the present invention relate to watercraft and specifically to a catamaran-style, recreational watercraft with a manually adjustable beam.

Referring to the drawings by numeral, the largest components of the present invention are the two, equal length, decked hulls 1, which are made from molded plastic or comparable marine-grade hull material.

The catamaran boat-form is realized by connecting the two hulls 1, port and starboard, so that they remain parallel to one another and aligned so that, if drawn in plan, a line touching both bow tips would be perpendicular to the longitudinal centerline of the craft.

In the present invention, the structural connection between hulls is made by at least two adjustable-length crossbars 3. Each adjustable-length crossbar 3 is composed of a pair of bar segments 4 and a piece of specialized hardware, referred to in this document as a "slide block" 5. The bar segments 4 are made from appropriately dimensioned, rigid tubes of aluminum or other corrosion resistant, material with comparable structural properties. Each bar segment 4 is fixed on one end to one of the two pontoons 1, leaving the opposite end unattached or free.

In the present embodiment the connections between bar segments 4 and hulls 1 is made by having the bar segments 4 lie across the deck surfaces of the hulls 1 in a direction perpendicular to the longitudinal centerline and using bolts or similar fasteners to secure the bar segments 4 through the deck surfaces of the hulls 1. The number and spacing of bolts used, holds the components securely together denying separation and racking. The mounting location of each bar segment 4 to its respective hull 1 is determined by the location of the slide blocks 5 relative to the platform deck 2 and position of the platform deck 2 relative to the hulls 1. In the present embodiment, the platform deck 2 will be roughly centered between the bow and stern. The slide blocks 5 are bolted or similarly mounted or formed into the underside of the platform deck 2, centered on the longitudinal centerline of the platform deck 2, one near the front edge and one near the rear edge.

The slide blocks 5 are fabricated from aluminum or other corrosion resistant, material with comparable structural properties. Each slide block 5 has two parallel passages and each passage is lined with UHMW plastic or material with similar wear properties and low coefficient of friction.

The function of each slide block 5 is to receive the free end of each of a pair of bar segments 4, one from each hull, and to align the bar segments 4 parallel to one another and to hold them parallel, while, at the same time, allowing the bar segments 4 to slide back and forth along the path dictated by the two passages.

In a given slide block 5 there is one lined passage for each of the bar segments 4 in a pair. The lined passages are spaced enough apart, so as to prevent contact between bar segments 4 as they slide past one another. The lined passages are dimensioned so as to allow bar segments 4 to pass freely but not sloppily through them.

Adjustable-length crossbars 3 are assembled by feeding the free end of a bar segment 4 connected to the port pontoon into one passage in a slide block 5 and feeding the free end of a bar segment 4 from the starboard hull into the other passage.

When all connections are made, as described above, and all bar segments 4 are fed into their respective slide block passages the relative positions of hulls 1 and platform deck 2 are locked in all planes but those intersected by the transverse axis. The hulls 1 are only able to be moved in and out relative to the longitudinal centerline of the platform deck.

Mounting the adjustable-length crossbars 3 to the underside of the platform deck 2 and to the topside of the hulls 1, dictates that the platform deck 2 will ride above the hulls 1. To mitigate the tensile and compressive forces acting upon the adjustable crossbars 3, the weight of the platform deck 2 and all that rests upon it is partially supported by the platform deck 2 itself, resting its longitudinal edges upon transverse ridges 7 formed or built into the deck surfaces of the hulls 1. The ridges 7 also elevate the deck, providing the necessary clearance to avoid contact and resulting friction between the underside of the platform deck 2 and the bar segments 4, while the position of the hulls 1 is being adjusted. The points of contact between the ridges 7 and the platform deck 2 will be made from or covered with a material with favorable wear properties and a low coefficient of friction.

When assembled in accordance with the descriptions above, the present embodiment can be configured into a range of widths. In its narrowest configuration, each outer longitudinal edge of the platform deck 2 is approximately flush with the outer edge of the hull 1 of that side, so that the narrowest possible beam of the craft is roughly equal to the width of the platform deck 2. When the craft is in its widest configuration, the outer edges of the platform deck 2 will overlap the inside edges of each hull's 1 deck surface, by approximately 1 to 3 inches.

Altering the lateral position of a given hull 1 is achieved manually. Each hull has a handle 6 securely mounted near its transverse center line on its top, outer edge. In order to change a hull's 1 lateral position, relative to the platform deck 2, the operator places his or her hand around the given handle 6 and applies force in the direction of the desired movement. The applied force will cause the bar segments 4 of the given hull 1 to slide in the direction of force through the passages in the stationary slide block 3 while the outer longitudinal edge of that side's platform deck ride across the surfaces of the hull's transverse ridges 7, thus, adjusting the lateral position of the given hull 1.

In the present embodiment, when the desired orientation for each hull is achieved their positions can be locked with a simple thread-driven friction brake 8. The brake works in a fashion similar to a t-bolt used in combination with a jig knob. The knob end of the bolt is located on the top side of the platform deck 2 with the bolt shaft running down through the platform deck 2, along the edge of a given slide block 3 and between the two bar segments 4. A flat, horizontal element at the bottom of the bolt shaft is oriented so that turning the knob in a given direction will raise the flat element until it makes contact with the undersides of each bar segment 4. Tightening the brake 8 will grab and hold the bar segments, thus holding the hulls 1 in their relative positions.

It should be understood that the particular embodiments conveyed in the included drawings and written descriptions are not meant to represent the sole embodiments of the present invention. Those skilled in the art will recognize that modifications may be made, producing variations, which maintain the spirit and novel features of the present invention, and do not fall beyond the scope of the present invention.

What is claimed is:

1. A catamaran-type watercraft with a manually adjustable beam, comprising:

a pair of equal-length decked hulls, said hulls connected to one another and held parallel to one another by at least two adjustable-length crossbars, each of said at least two adjustable-length crossbars comprising a stationary slide block and a pair of sliding bar segments, each of said at least two adjustable-length crossbars oriented perpendicularly to and spanning said hulls, with one end of each of said adjustable-length crossbars fixed at a determined placement on a deck surface of one of the hulls and an opposite end of each of said adjustable-length crossbars fixed at a determined placement on a deck surface of a remaining hull of the hulls;

a rigid, operator-bearing platform deck linked to said hulls by connection to each of said at least two adjustable-length crossbars, said slide blocks being fixably mounted to an underside of said platform deck at locations approximately centered on a longitudinal centerline of said platform deck, with at least one of said slide blocks located near a bow-end of said platform deck and at least one other of said slide blocks located near a stern-end of said platform deck, said platform deck residing in a plane above a highest point of deck surfaces of the hulls;

a pair of handles one mounted to each of said hulls, said handles being positioned near a transverse center along a top, outer edge of each of said hulls, said handles providing points of interface for applying force required to laterally position said hulls; and a friction brake comprising a tightening knob accessible to an operator of said watercraft, whereby said tightening knob is constructed and arranged to increase and decrease frictional force equally to each of said sliding bar segments of the at least two adjustable-length crossbars.

2. The watercraft of claim 1 wherein said at least two adjustable-length crossbars are constructed and arranged to provide lateral positioning of said hulls by establishing stationary passages through which each of the sliding bar segments move parallel to one another in independent directions along a shared transverse plane.

3. The watercraft of claim 2 wherein the slide blocks comprise two narrowly spaced parallel, passages dimensioned to accept said sliding bar segments, allowing the sliding bar segments to slide freely through said passages.

4. The watercraft of claim 2 wherein said slide blocks are constructed and arranged to maintain said each of the sliding bar segments in parallel paths, wherein each of the at least two adjustable-length crossbars form a structural member for resisting operationally related bending forces.

5. The watercraft of claim 1 wherein the platform deck comprises a width that is substantially equal to a width of a beam of said watercraft when said watercraft is formed in its narrowest configuration, and wherein said platform deck comprises a length sufficient to accommodate a seated operator, and said platform deck is constructed and arranged to support a seated operator on said platform deck.

6. The watercraft of claim 1 wherein said hulls have a generally flat and generally horizontal deck surface where said hulls are covered by said platform deck when said watercraft is fully retracted.

7. The watercraft of claim 6 wherein lateral ridges are formed in said hulls, wherein said lateral ridges are constructed and arranged to support said platform deck, and to reduced operationally related stresses conveyed to said adjustable-length crossbars and to provide clearance between an underside of said platform deck and said sliding bar segments when adjusting at position of said hulls.

8. The watercraft of claim 1, wherein a dimension of the beam of said water-craft is adjustable when lateral force applied to either of said hulls at a handle of the pair of handles, the lateral force causing a bar segment of the sliding bar segments to slide through said slide blocks, thereby increasing or decreasing a length of said adjustable length crossbars.

9. A catamaran-type watercraft having an adjustable beam, comprising: a pair of hulls, each of said hulls connected to another of said hulls and held parallel to another of said hulls by at least two adjustable-length crossbars, each of said at least two adjustable-length crossbars comprising a stationary slide block and a pair of sliding bar segments, each of said at least two adjustable-length crossbars spanning said hulls, with one end of each of said at least two adjustable-length crossbars fixed at a determined placement on a deck surface of one of the hulls and an opposite end of each of said adjustable-length crossbars fixed at a determined placement on a deck surface of a remaining hull of the hulls;

said slide blocks being mounted to a platform deck, and wherein said platform deck is positioned above deck surfaces of the hulls; and a brake that communicates with an adjustable length crossbar of the at least two adjustable-length crossbars, wherein the brake is constructed and arranged to increase and decrease a force applied to the adjustable length crossbar.

10. The watercraft of claim 9, further comprising a handle mounted to one of the hulls, said handle constructed and arranged receive and apply manual force required to laterally position said hulls.

11. The watercraft of claim 9 wherein said at least two adjustable-length crossbars are constructed and arranged to provide lateral positioning of said hulls by establishing stationary passages through which each of the sliding bar segments move parallel to one another in independent directions along a shared transverse plane.

12. The watercraft of claim 9 wherein the slide blocks comprise narrowly spaced parallel, passages constructed and arranged to receive said sliding bar segments within said passages and to allow the slide blocks to slide freely relative to said passages.

13. The watercraft of claim 9 wherein said slide blocks are constructed and arranged to maintain said sliding bar segments in parallel paths.

14. The watercraft of claim 9 wherein the platform deck comprises a width that is substantially equal to a width of a beam of said watercraft when said watercraft is formed in its narrowest configuration, and wherein said platform deck comprises a length sufficient to accommodate a seated operator, and said platform deck is constructed and arranged to support a seated operator on said platform deck.

15. The watercraft of claim 9 wherein said hulls have a generally flat and generally horizontal deck surface where said hulls are covered by said platform deck when said watercraft is fully retracted.

16. The watercraft of claim 9, further comprising a ridge formed over each hull of said hulls, wherein said ridge is constructed and arranged to support said platform deck and to provide clearance between an underside of said platform deck and said sliding bar segments.

17. The watercraft of claim 9, wherein a dimension of the beam of said watercraft is modified when lateral force applied to either of said hulls by the lateral force causing a bar segment of the sliding bar segments to slide through said slide blocks.

18. The watercraft of claim 9, wherein an actuator for the brake extends above a top surface of the platform deck.

* * * * *